US007494082B2

(12) United States Patent
Strzelczyk et al.

(10) Patent No.: US 7,494,082 B2
(45) Date of Patent: Feb. 24, 2009

(54) DEVICE FOR WINDING WIRE AND CABLE

(75) Inventors: Paul Strzelczyk, Hagen (DE); Rainer Vockentanz, Schwabach (DE); Günter Engmann, Schwabach (DE); Thomas Schmidt, Schwabach (DE)

(73) Assignee: Maschinenfabrik Niehoff GmbH & Co. KG, Schwabach (DE)

( * ) Notice: Subject to any disclaimer, the term of this patent is extended or adjusted under 35 U.S.C. 154(b) by 141 days.

(21) Appl. No.: 10/548,576

(22) PCT Filed: Mar. 10, 2004

(86) PCT No.: PCT/EP2004/002472

§ 371 (c)(1),
(2), (4) Date: May 11, 2006

(87) PCT Pub. No.: WO2004/080873

PCT Pub. Date: Sep. 23, 2004

(65) Prior Publication Data

US 2006/0208123 A1 Sep. 21, 2006

(30) Foreign Application Priority Data

Mar. 10, 2003 (DE) ..... 103 10 323

(51) Int. Cl.
*B21C 47/10* (2006.01)
*D04H 11/00* (2006.01)

(52) U.S. Cl. ..... 242/361.4; 19/159 R

(58) Field of Classification Search ..... 242/360, 242/361, 361.1, 361.2, 361.3, 361.4, 362, 242/362.1; 19/159 R, 159 A, 149
See application file for complete search history.

(56) References Cited

U.S. PATENT DOCUMENTS

| | | | |
|---|---|---|---|
| 2,849,195 | A | 8/1958 | Richardson et al. |
| 3,033,484 | A | 5/1962 | Crum |
| 6,019,303 | A | 2/2000 | Cooper |
| 6,260,781 | B1 | 7/2001 | Cooper |

FOREIGN PATENT DOCUMENTS

| | | |
|---|---|---|
| DE | 1 161 839 | 1/1964 |
| DE | 1 280 190 | 10/1968 |

*Primary Examiner*—Peter M Cuomo
*Assistant Examiner*—William E Dondero
(74) *Attorney, Agent, or Firm*—Greer, Burns & Crain, Ltd.

(57) ABSTRACT

A device for winding wire, cable or other winding material includes a device stand with a wobble drive generating a wobbling motion about a vertical axis, a supporting stand is connected to the wobble drive such that, first pivot bearings of the wobble drive are attached to the front face of the device stand and, second pivot bearings are attached to the supporting stand and the pivot bearings are connected to one another by crank arms, wherein the wobbling motion can be transmitted to the supporting stand such that the supporting stand performs a wobbling motion relative to the device stand, that the supporting stand has the winding device for the winding material attached to it such that the wobbling motion can be transmitted to the winding device, that the winding material can be deposited in the collecting device using the winding device which performs the wobbling motion.

15 Claims, 3 Drawing Sheets

FIG. 4
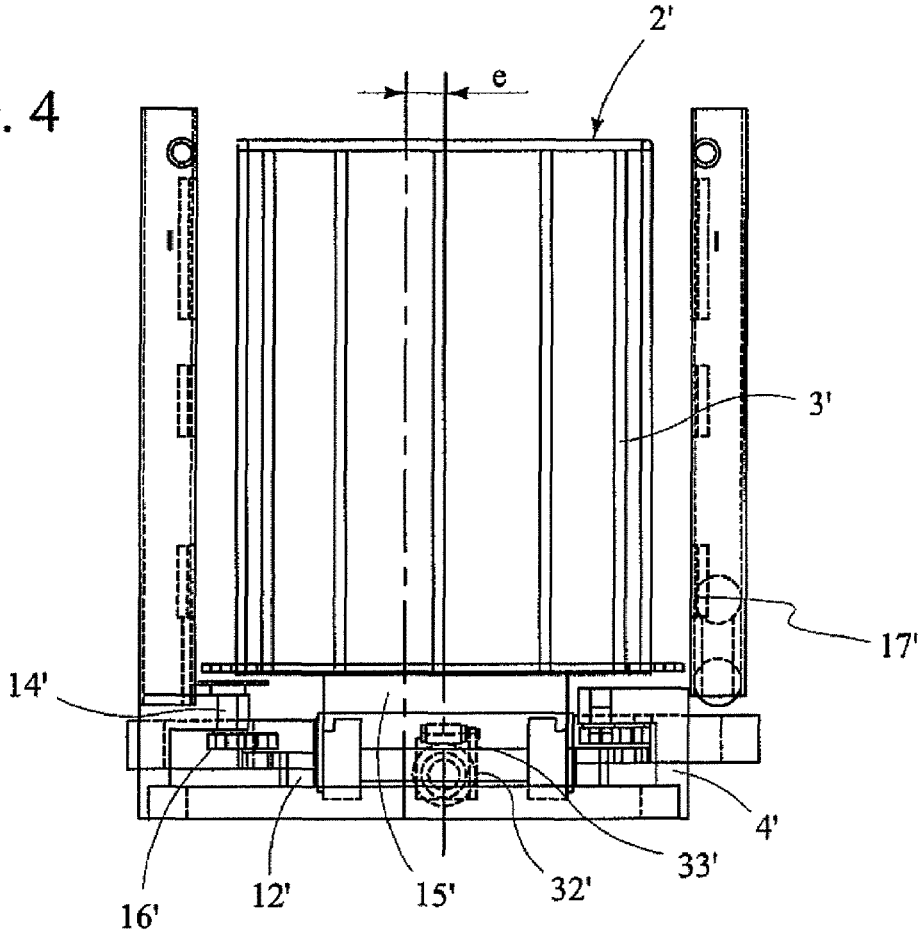
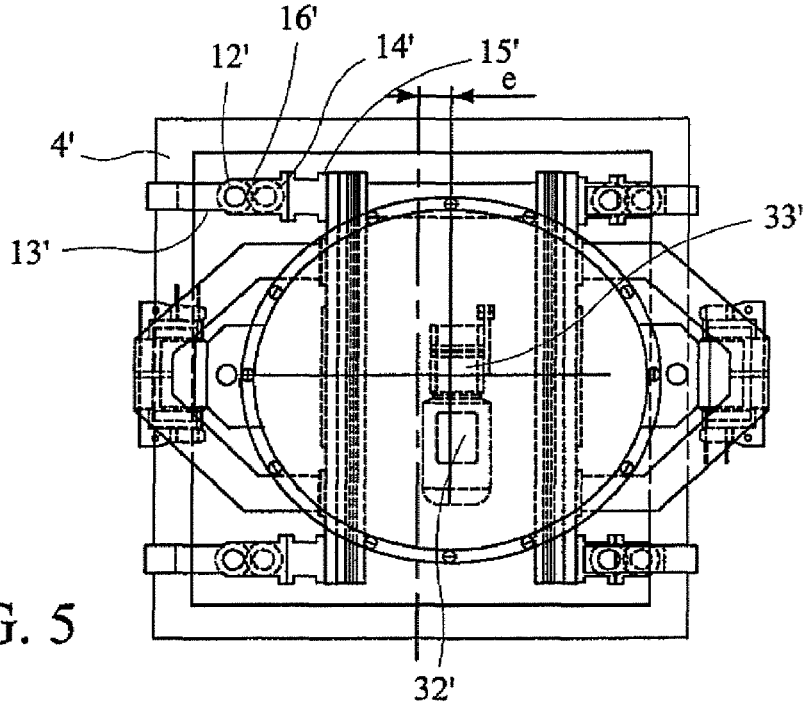
FIG. 5

DEVICE FOR WINDING WIRE AND CABLE

BACKGROUND

The invention relates to a device for winding wire, cables or the like winding material where a guide pulley on a rotating winding head radially deflects the winding material from the initially axial infeed direction and a pressure roller pivoted at the winding arm acts under applying a longitudinal traction to press said winding material against the wall of a drum that rotates in a first case, such that the winding material drops off the drum under helical expansion, dropping down into a winding material container beneath that is stationary in the first case, while preferably developing a rosette-like deposit pattern wherein feeding and diverting means for the winding material are arranged above said winding head.

A device of said first type is known from DE-AS 1 280 190.

In a second case, the invention further relates to a device for winding wire, cables or the like winding material where a guide pulley on a rotating winding head radially deflects the winding material from the initially axial infeed direction and a pressure roller pivoted at the winding arm acts under applying a longitudinal traction to press said winding material against the wall of a drum that is stationary in this second case, such that the winding material drops off the drum under helical expansion, dropping down into a winding material container arranged beneath that rotates in this second case while preferably developing a rosette-like deposit pattern wherein feeding and diverting means for the winding material are arranged above said winding head.

A device of said second type is known from DE-PS 1 161 839.

The known first type device differs from the known second type device only in that in the first case, the drum rotates and the winding material container is stationary, while in the second case, the drum is stationary and the winding material container rotates.

Both devices operate on the same principle of relative movement, in this case rotation, between the drum on the one hand and the winding material container on the other hand.

Modifying the density of the wire loops or wire coils deposited in a rosette-like pattern is a laborious procedure with the known devices since the entire machine must be stopped and the corresponding drive gears changed.

Laying out wire in the winding material container such as a barrel in a rosette pattern at varying densities would, if at all possible, require considerable effort. Moreover, employing the known device may lead to damage to sensitive winding material such as cables.

SUMMARY

On the basis of this prior art it is the object of the invention to provide a device of the relevant type where the rosette density of the deposit pattern can be readily changed without stopping the device, the wound rosettes are gently deposited in the winding material container and/or where the rosettes can be readily wound and deposited at varying densities without rotating the winding material container.

This object is fulfilled by the devices for winding wire, cable or the like winding material and by the methods of winding wire, cable or the like winding material according to the features of the respective independent patent claims.

To fulfill this object the invention proposes to provide a device stand with a wobble drive arranged at it which generates a wobbling motion about a vertical axis. Further, a supporting stand (15) is provided that is connected to the wobble drive such that the wobbling motion can be transmitted to the supporting stand such that the supporting stand (15) performs a wobbling motion relative to the device stand (4). The winding device for the winding material (1) is to be fastened to the supporting stand (15) such that the wobbling motion can be transmitted to the winding device and the winding material (1) can be deposited in the collecting device using the winding device with the winding device performing the wobbling motion.

The invention further fulfills this object by means of a device stand with a wobble drive arranged at it which generates a wobbling motion about a vertical axis. Further, a supporting stand (15) is provided that is connected to the wobble drive such that the wobbling motion can be transmitted to the supporting stand such that the supporting stand (15) performs a wobbling motion relative to the device stand (4). In this case the collecting device for the winding material (1) is to be fastened to the supporting stand (15) such that the wobbling motion can be transmitted to the collecting device and the winding material (1) can be deposited in the collecting device using the winding device with the collecting device performing the wobbling motion.

On the one hand the invention provides that only the device stand and the collecting device where the winding material is deposited are stationary while the entire winding device is fastened to the supporting stand which performs wobbling motions due to the wobbling drive so as to cause the winding material to be deposited in the collecting device in a rosette pattern.

On the other hand—i.e. with the principle of the invention reversed—only the device stand and the winding device are stationary while the collecting device is fastened to the supporting stand which performs wobbling motions due to the wobbling drive so as to cause the winding material to be deposited in the collecting device in a rosette pattern.

The rosette density can be changed by changing the velocity of the wobble drive which can be done without stopping the device, i.e. while the device is in operation.

In addition the wobble drive causes the eccentric depositing motion to be relatively large such that the winding material can be deposited in a rosette pattern very gently and without damaging the winding material. Depositing the winding material at varying densities in the collecting device such as a barrel is also conceivable.

A wobbling drive or wobbling motion according to the invention is understood to include eccentric drives or eccentric motion.

Preferred specific embodiments of the invention can be taken from the dependent claims.

The specific embodiments further described refer both to the devices and the methods.

A preferred specific embodiment provides on the one hand first pivot bearings of the wobble drive attached to the front face of the device stand, and on the other hand second pivot bearings attached to the supporting stand. The pivot bearings are connected to one another by crank arms.

It is considered a preferred specific embodiment where the collecting device such as a barrel has a vertically adjustable deposit table for the winding material retained therein.

It is preferably provided that said deposit table is lowered into the barrel in relation to the quantity of winding material deposited thereon.

The configuration of the vertically adjustable deposit table, in particular in conjunction with a controlled vertical adjustment in relation to the quantity of the deposited winding material allows for a very gentle deposit of the winding material in the barrel since the depositing level is arranged close to that of the actual winding device and will be maintained even with increasing quantity of deposited winding material by way of the deposit table being progressively lowered toward the barrel base in relation to the increasing quantity of winding material.

In order to realize a gentle feeding of the winding material into the devices even with the wobble drive it is provided that a first retainer is arranged at the device stand above the supporting stand and a second retainer arranged at the supporting stand above the wobble drive, the ends of an extension and compression-rigid anchor such as a rod or a tube are pivotally joined to the retainers by means of a ball joint, and that the anchor has winding material guide rollers pivotally supported at or near its ends wherein the roller axes are aligned substantially parallel relative to one another.

This configuration allows that movement of the guide rollers over which the entering winding material is guided, follows the movement of the wobble drive such that the entering characteristics of the winding material will not vary.

A balancing of the winding head can thus be achieved which is of particular importance in the case of a winding head performing eccentric movements, in particular on account of irregular entering of the winding material or wire into the device caused for example by constantly changing distances from preceding machines.

It is in particular preferred to further provide that the winding material be guided from the upper to the lower guide roller through the tube type anchor.

A very preferred specific embodiment is considered to be one where the supporting stand comprises a mounting plate aligned in parallel to the front face of the device stand, which mounting plate supports, on its side facing away from the barrel guiding and diverting means for the winding material, and that the guide and diverting means includes a driven pre-pulling edge head that is rotatable about an axis line approximately parallel to the guide roller axes and around which the winding material is wrapped, which pre-pulling edge head is slightly inclined so as to guide the entering winding material strand past the strand exiting toward the winding device.

This configuration, in particular the configuration of the driven pre-pulling edge head, allows to omit separate winding material pulling drives and in particular balancing means required in this case such as by means of a dancer between the pulling drive and the winding device. This construction also furthers a gentle traveling of the winding material.

In order to achieve that the drive of the winding head, the drive roller and the pre-pulling edge head be controlled such that the winding material will have the same speed in all of the areas, a preferred embodiment provides only one drive motor connected through a first transmission to the winding head, through a second transmission to a drive roller arranged between the guide pulley and at least one winding head pressure roller at a rotational axis parallel to said at least one pressure roller, and through a third transmission to the pre-pulling edge head.

The at least one or if provided several pressure rollers may be spring-mounted. The several pressure rollers may also be connected by means of a revolving belt.

This preferred embodiment, graphically described as a pre-pulling device for minimizing tensile forces on the winding material, serves in particular to take "pull" out of the winding material.

This allows to realize unimpeded winding when winding the winding material onto a winding drum in particular in a lower portion of the winding drum since there will always occur a counter-pull to a wire traction from an upstream dancer, a speed variation compensating device.

The pre-pulling device, for example mounted on top of a winder, can minimize the wire traction on or at the drum.

The transmissions may be positively coupled to the drive motor via cog belts or gear wheels.

The winding material may be a bare wire of various materials or coated wire or an insulated conductor or a cable.

It can further be provided to press the winding material against an inside drum wall. Alternatively it can be provided to press the winding material against the outside drum wall. In this second case a continuous flat belt may be provided for pressing the winding material against an outside drum casing.

Embodiments of the invention are illustrated in drawings and will be described in more detail below.

BRIEF DESCRIPTION OF THE DRAWINGS

The drawings show in:

FIG. 4 a partially sectional side view of essential components of a second device (wobble barrel) of the invention according to a second embodiment;

FIG. 5 a top view of the lower portion of the second device.

DETAILED DESCRIPTION

First Embodiment: "Wobble Head"

Figure 1:
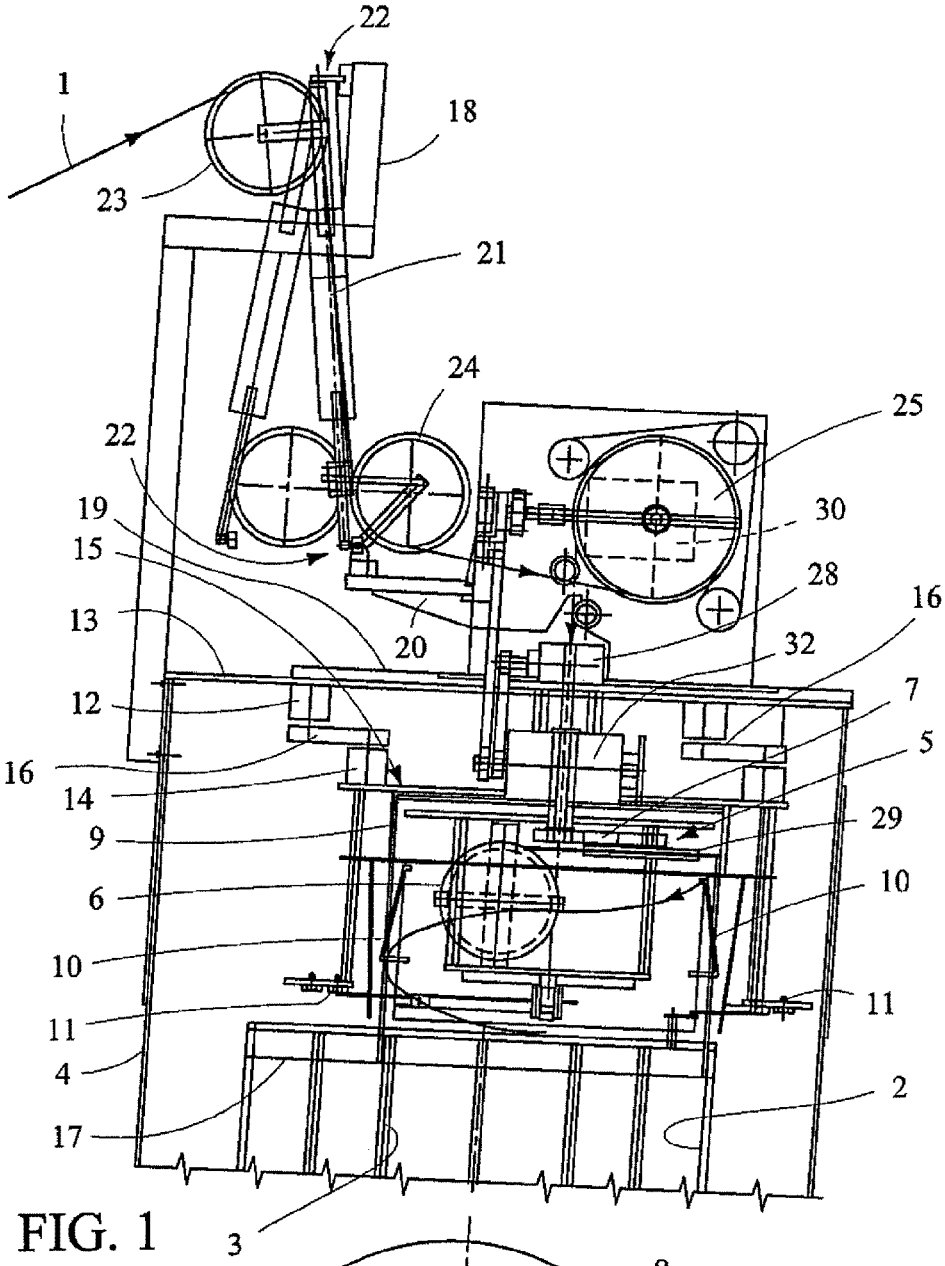
FIG. 1 a partially sectional side view of essential components of a first device (wobble head) of the invention according to a first embodiment.
Figure 2:
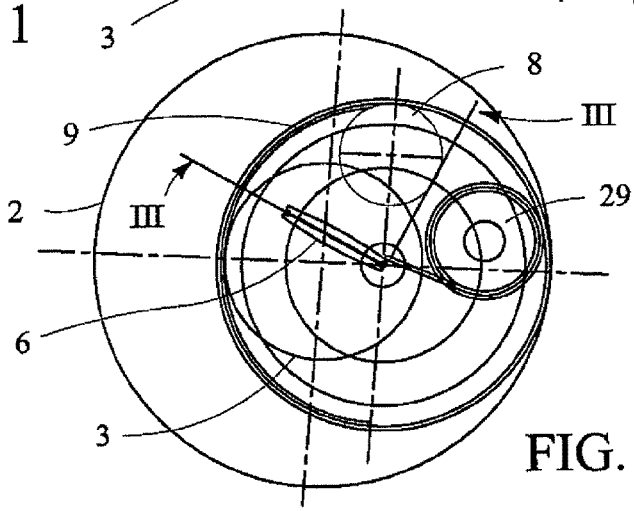
FIG. 2 a top view of the lower portion of the first device.
Figure 3:
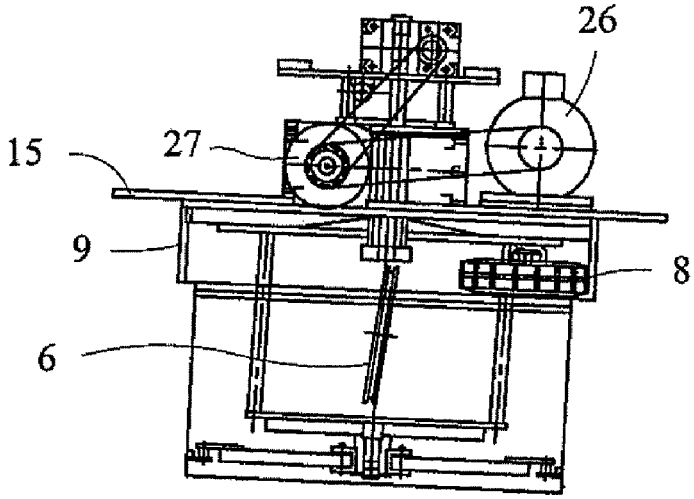
FIG. 3 a view along the intersection line III/III in FIG. 2.

FIG. 1 shows a first device of the invention having a wobble head.

This device serves to gently deposit winding material 1 in a rosette pattern in a stationary barrel 2 having an outer casing and an inner cylindrical core 3 such that the winding material can easily and without obstruction be pulled out of the filled barrel at a later time. The barrel 2 is located stationary on a base. Furthermore, a fixed device stand 4 is positioned. The device further comprises a winding head 5 rotating about a vertical axis and a guide pulley 6 mounted downstream in the direction of flow wherein the winding material is radially deflected by the guide pulley 6 from an axial infeed direction and a pressure roller 8 pivoted at the winding arm 7 acts under applying a longitudinal tracion to press said winding material against the inside wall of a rotating drum 9, such that subsequently the winding material, drops off the drum 9 under helical expansion and drops into the stationary barrel placed beneath developing a rosette-like deposit pattern. The dropping path of the winding material loop dropping off the drum 9 includes fingers 10 arranged therein which lead to some agitation of the dropped coils which assists the depositing action but is not absolutely necessary. Means 11 are furthermore provided which during changing barrels retain the deposited winding material loops until another barrel is placed beneath the device. Such retaining means 11 are known in the prior art.

Feeding and diverting means for the winding material 1, to be described below, are arranged above the winding head 5.

The device stand 4 has a wobble drive arranged at it that is operated through a drive motor arranged firmly at the stand, and a transmission. Said wobble drive generates a wobbling motion about a vertical axis wherein first pivot bearings 12 of the wobble drive are attached at the front face 13 of the attached device stand 4 and second pivot bearings 14 are attached to a supporting stand 15 and the pivot bearings 12, 14 are connected to one another by means of crank arms 16. The supporting stand 15 has the entire winding device and also the feeding and diverting device for the winding material 1 attached to it. Due to the motion of the wobble drive the entire supporting stand including the winding device performs a wobbling motion relative to the device stand 4 wherein the front face 13 of the device stand 4 has a suitably sized cutout provided in it for the corresponding wobble drive elements to be reached.

Additionally the barrel 2 has a vertically adjustable deposit table 17 for the winding material arranged in it. Preferably the deposit table 17 is progressively lowered into the barrel 2 depending on the quantity of winding material deposited thereon so as to achieve a gentle depositing of the winding material.

A first retainer 18 is arranged at the device stand 4 above the supporting stand 15 and a second retainer 20, to the supporting stand 15 or elements 19 supported on the supporting stand 15. The retainers 18 and 20 have the ends of an extension and compression-rigid anchor 21, in the embodiment of a tube, articulated to it by a ball joint 22 each. Guide rollers 23, 24 for the winding material 1 are pivoted near the anchor ends wherein the roller axes are aligned substantially parallel relative to one another. The guide rollers 23, 24 and the anchor 21 combined can follow the wobble drive motion, said rollers being slightly inclined subject to the wobble drive motion so as to allow a constraint-free guidance of the winding material 1, the wobble drive motion notwithstanding.

The supporting stand 15 further comprises a mounting plate 19 aligned parallel with the front face 13 of the device stand 4 and attached to the supporting stand 15, and carrying winding material guiding and diverting means on its side facing away from the barrel 2. This device consists in particular of a driven pre-pulling edge head 25 that is rotatable about an axis line approximately parallel to the axes of the guide rollers 23, 24 and around which the winding material 1 is wrapped. The pre-pulling edge head 25 is slightly inclined so as to guide the entering and the exiting winding material 1, whose paths cross, past one another.

This pre-pulling edge head 25 allows to omit separate pulling drives for the winding material 1 and consequently also balancing means such as dancers or the like between the pulling drive and the winding device. This configuration furthers gentle handling of the winding material 1.

Apart from the separate drive motor 32 provided for the wobble drive, only one other drive motor 26 is mounted to the components moving due to the wobble drive, which motor drives the winding head 5 via a first transmission 27. A second transmission 28 couples the motor 26 to a drive roller 29 whose rotational axis is parallel to the pressure roller 28 and which is arranged between the guide pulley 6 and the pressure roller 7 of the winding head. The drive motor 26 is furthermore coupled with the pre-pulling edge head 25 via a third transmission 30. The drive motor 26 is preferably connected with the transmission through toothed belts while the transmissions in turn are connected to the corresponding elements via gear wheels or the like which results in a forced synchronism such that the winding material will always be conveyed at the same speed.

The winding material is drawn in over the pre-pulling edge head 25, traveling over the guide roller 23, the guide roller 24 to the pre-pulling edge head 25 around which it wraps and from which it travels vertically downwardly through a hollow shaft. Subsequently the winding material travels around the guide roller 6 and further to the drive roller 29. It is then pressed against the casing of the component 9 by the pressure roller 8 and corresponding to the superimposed rotating and wobbling motion it is deposited in the barrel 2, in particular on the elevating base plate 17.

All of the rollers are located at slightly inclined positions so as to ensure that where the entering and the exiting paths of the winding material cross there will be no contact of the winding material.

The pressure roller 8 is not driven and its outer surface is provided with a soft resilient layer such as rubber. Preferably the rotational directions of the wobble drive and the winding drive are aligned.

Second Embodiment: "Wobble Barrel"

FIG. 4 and FIG. 5 show a second device of the invention having a wobble barrel.

This second device, the wobble barrel, has the principle of the invention realized in reverse configuration.

In this case, the barrel 2' has a wobble support while the winding head (FIG. 1) is stationary.

Otherwise the second device corresponds to the first. Corresponding components of the device are designated the same.

This second device also serves to gently deposit in a rosette-like pattern winding material (FIG. 1) in this wobble barrel 2' comprising an outer casing and an inner cylindrical core 3' such that the winding material can easily and without obstruction be pulled out of the filled barrel at a later time.

The device stand 4' has a wobble drive 32' arranged at it that is operated through a drive motor 32' firmly arranged at the stand, and a transmission 33'.

Said wobble drive 32' generates a wobbling motion about a vertical axis wherein first pivot bearings 12' of the wobble drive are attached at the front face 13' of the attached device stand 4' and second pivot bearings 14' are attached to a supporting stand 15' and the pivot bearings 12', 14' are connected to one another by means of crank arms 16'.

The supporting stand 15' has the barrel 2' attached to it. Due to the motion of the wobble drive 32', the entire supporting stand 15' including the barrel 2' performs a wobbling motion relative to the device stand 4'.

Additionally the barrel 2' also has a vertically adjustable deposit table 17' for the winding material arranged in it. Preferably the deposit table 17' is progressively lowered into the barrel 2' depending on the quantity of winding material deposited thereon so as to achieve a gentle depositing of the winding material.

The invention is not limited to the two embodiments but allows multiple variations within the scope of the disclosure.

All of the new individual and combined features disclosed in the specification and/or the drawing are considered to be material to the invention.

The invention claimed is:

1. A device for winding a material, comprising:

a device stand including a wobble drive constructed and arranged to generate a wobbling motion about a vertical axis, a supporting stand connected to said wobble drive, first pivot bearings attached to a front face of said device stand and second pivot bearings attached to said supporting stand, said first and second pivot bearings being connected to each other by crank arms, wherein said crank arms transfer the wobbling motion from said first pivot bearings to said second pivot bearings on said supporting stand such that said supporting stand performs the wobbling motion relative to said device stand, a winding device attached to said supporting stand such that the wobbling motion is transmitted to said winding device, and a collecting device constructed to receive the material from said winding device while said winding device performs the wobbling motion.

2. The device according to claim 1, wherein said collecting device has a vertically adjustable deposit table.

3. The device according to claim 2, wherein said deposit table can be lowered into said collecting device based on the quantity of the material deposited thereon.

4. The device according to claim 1, wherein said collecting device is a barrel.

5. The device according to claim 1, wherein said device stand has a first retainer and a second retainer, said first retainer positioned above said supporting stand and said second retainer positioned above said wobble drive, a first end of an extension and a compression-rigid anchor are pivotally attached to said first and second retainers by a ball joint, said first end and a second end of said anchor respectively including an upper guide roller and a lower guide roller for the material pivoted to said upper and lower guide rollers, wherein axes of said upper guide roller and said lower guide roller are aligned substantially parallel to each other.

6. The device according to claim 5, wherein the material is guided from said upper guide roller to said lower guide roller through said anchor configured as a tube.

7. The device according to claim 5, wherein said supporting stand comprises a mounting plate mounted on said supporting stand and aligned parallel with said front face of said device stand, and carrying guiding and diverting means for the material at a side facing away from said collecting device, and wherein said guiding and diverting means including a pre-pulling edge head that is rotatable about an axis aligned approximately parallel with the axes of the upper and lower guide rollers, wherein the pre-pulling edge head is slightly inclined to guide an entering material strand past a strand exiting toward said winding device.

8. The device according to claim 1, wherein said winding device includes at least one winding head having a guide pulley, a winding arm having at least one pressure roller pivoted thereto and a drum, wherein the winding material is radially deflected by said guide pulley on said winding head from an initially axial infeed direction and said at least one pressure roller pivoted at the winding arm applies a longitudinal traction to the material to press the material against an inner wall of said drum, such that the material pressed against said drum drops off under helical expansion, dropping down into said collecting device arranged beneath said winding device while preferably developing a rosette deposit pattern.

9. The device according to claim 1, wherein said supporting stand includes a drive motor which is connected, through a first transmission to said winding head, through a second transmission to a drive roller arranged between said guide pulley and at least one pressure roller on said winding head at a rotational axis parallel to said at least one pressure roller, and through a third transmission to a pre-pulling edge head.

10. The device according to claim 1, wherein said supporting stand has feeding and diverting means for the material arranged above a winding head.

11. A device for winding a material, comprising:

a device stand including a wobble drive constructed and arranged to generate a wobbling motion about a vertical axis, a supporting stand connected to said wobble drive, first pivot bearings attached to a front face of said device stand and second pivot bearings attached to said supporting stand, said first and second pivot bearings being connected to each other by crank arms, wherein said crank arms transfer the wobbling motion from said first pivot bearings to said second pivot bearings on said supporting stand such that said supporting stand performs a wobbling motion relative to said device stand, and a collecting device attached to said supporting stand such that the wobbling motion is transmitted to said collecting device, the material being deposited in the collecting device while said collecting device performs the wobbling motion.

12. A method for winding a material where the material is deposited in a collecting device using a rotating winding device while developing a rosette deposit pattern, comprising:

a wobble drive on a device stand that generates a wobbling motion about a vertical axis, a supporting stand connected to said wobble drive, the wobbling motion being transmitted to said supporting stand, first pivot bearings of the wobble drive attached to a front face of said device stand and a second pivot bearings attached to said supporting stand, the pivot bearings being connected to one another by crank arms, such that said supporting stand performs a wobbling motion relative to said device stand, the wobbling motion being transmitted to said winding device for the material attached to said supporting stand, and the material being deposited in said collecting device using said winding device while the wobbling motion is performed by said winding device.

13. The method according to claim 12, wherein the material is deposited using the winding device while a wobbling motion is performed by said winding device, the winding material is radially deflected by a guide pulley on a rotating winding head from an initially axial infeed direction and at least one pressure roller pivoted at a winding arm acts under applying a longitudinal traction to press the material against a wall of a rotating drum such that the material pressed against the drum drops off under helical expansion into a stationary collecting device placed beneath said winding device in a rosette deposit pattern.

14. A method for winding a material wherein the material is deposited in a rotating collecting device using a winding device in a rosette deposit pattern, comprising:

a device stand including a wobble drive that generates a wobbling motion about a vertical axis, a supporting stand connected to said wobble drive, first pivot bearings of the wobble drive attached to a front face of said device stand, and second pivot bearings attached to said supporting stand, said first and second pivot bearings being connected by crank arms, such that said supporting stand performs a wobbling motion relative to said device stand, the wobbling motion is transmitted to said collecting device for the material attached to said supporting stand, the winding material is deposited in a collecting device while said collecting device performs a wobbling motion.

15. The method according to claim 14, wherein the material is deposited using said winding device while said collecting device performs the wobbling motion, so that the material is radially deflected by a guide pulley on a winding head from an initially axial infeed direction and at least one pressure roller pivoted at a winding arm that applies longitudinal traction to the material to press the material against a wall of a stationary drum, such that the material pressed to the wall of the drum drops off under helical expansion and drops into the collecting device placed generally beneath said winding device, which performs the wobbling motion while developing a rosette pattern.

* * * * *